US009810410B1

(12) United States Patent
Mart

(10) Patent No.: US 9,810,410 B1
(45) **Date of Patent: *Nov. 7, 2017**

(54) LED LIGHT HAVING LED CLUSTER ARRANGEMENTS

(71) Applicant: Gary K. Mart, Bonita Springs, FL (US)

(72) Inventor: Gary K. Mart, Bonita Springs, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/834,687

(22) Filed: Aug. 25, 2015

Related U.S. Application Data

(63) Continuation of application No. 13/729,736, filed on Dec. 28, 2012, now Pat. No. 9,115,876.

(60) Provisional application No. 61/582,101, filed on Dec. 30, 2011.

(51) Int. Cl.

| | |
|---|---|
| ***F21V 23/04*** | (2006.01) |
| ***F21S 4/00*** | (2016.01) |
| ***F21V 23/00*** | (2015.01) |
| ***F21S 8/08*** | (2006.01) |
| ***F21V 29/70*** | (2015.01) |
| *F21W 131/103* | (2006.01) |
| *F21Y 101/02* | (2006.01) |
| *F21Y 105/00* | (2016.01) |

(52) U.S. Cl.
CPC ..... *F21V 23/005* (2013.01); *F21S 8/086* (2013.01); *F21V 23/04* (2013.01); *F21V 29/70* (2015.01); *F21W 2131/103* (2013.01); *F21Y 2101/02* (2013.01); *F21Y 2105/003* (2013.01)

(58) Field of Classification Search
CPC .... F21Y 2105/12; F21V 23/005; F21V 29/70; F21S 8/086; F21W 2131/103
See application file for complete search history.

(56) References Cited

U.S. PATENT DOCUMENTS

| | | | | |
|---|---|---|---|---|
| 6,857,767 | B2 * | 2/2005 | Matsui | F21V 29/004 257/E25.02 |
| 7,993,021 | B2 * | 8/2011 | Roberts | G09F 9/35 315/185 S |
| 8,864,326 | B2 * | 10/2014 | Armer | G03B 15/02 362/158 |
| 9,086,213 | B2 * | 7/2015 | Harbers | F21V 7/22 |
| 9,115,876 | B1 * | 8/2015 | Mart | F21V 23/005 |
| 2007/0242461 | A1 * | 10/2007 | Reisenauer | F21V 25/10 362/294 |
| 2008/0170396 | A1 * | 7/2008 | Yuan | F21K 9/00 362/244 |

* cited by examiner

*Primary Examiner* — Alan Cariaso
(74) *Attorney, Agent, or Firm* — Patents on Demand P.A.; Brian K. Buchheit

(57) ABSTRACT

An improved light-emitting diode (LED) light fixture can include a circuit board, multiple LED clusters, and a master power controller. The LED clusters can be arranged on the circuit board and can include at least seven LEDs electrically connected in series and a regulator circuit. The LEDs of an LED cluster can be arranged such that one LED is located at a central point of the LED cluster and the remaining LEDs are arranged in a circular geometry around the center LED. The master power controller can be coupled to the circuit board and can be configured to control power provided to the LED clusters.

19 Claims, 8 Drawing Sheets

LED LIGHT HAVING LED CLUSTER ARRANGEMENTS

CROSS-REFERENCE TO RELATED APPLICATION

This application is a continuation of and claims the benefit of U.S. patent application Ser. No. 13/729,736 filed on Dec. 28, 2012, which claims the benefit of Provisional Application Ser. No. 61/582,101 entitled "CONTROL AND LIGHTING SYSTEM", filed Dec. 30, 2011, and U.S. patent application Ser. No. 12/996,221 entitled "LED LIGHT BULB." application Ser. Nos. 13/729,736, 12/996,221, and 61/582,101 are herein incorporated by reference in their entirety.

BACKGROUND

The present invention relates to the field of lighting and, more particularly, to an improved light-emitting diode (LED) light having LED cluster arrangements.

Recent trends have made it commonplace to replace energy-inefficient incandescent and fluorescent light bulbs with energy-efficient light-emitting diode (LED) bulbs. The benefits of LED light bulbs include low energy consumption, long lifetime, low heat production, slow failure, and the ability to be quickly cycled on and off. In large indoor spaces (i.e., industrial lighting) or outdoor spaces (i.e., streetlights), where the produced light needs to illuminate across a substantial distance, the adoption of LED light use has been slow.

These types of spaces require the use of high-powered LED lights, which have higher initial and operating costs. Switching to high-powered LED lights in these spaces requires specially-designed LED lighting fixtures that allow the LED light to be retrofitted into the existing incandescent or fluorescent lighting system, hence the higher price. These retrofitted LED lights must compensate for environmental and fundamental operating differences between an incandescent or fluorescent lighting system and a LED lighting system.

For example, incandescent bulbs operate using commercial alternating current (AC); fluorescent bulbs use a ballast to limit the current through the bulb. An LED light operates using a direct current (DC) power source. Thus, an LED light retrofitted for use in an existing incandescent lighting system must account for this difference in power source.

BRIEF SUMMARY

One aspect of the present invention can include an improved light-emitting diode (LED) light fixture that includes a circuit board, multiple LED clusters, and a master power controller. The LED clusters can be arranged on the circuit board and can include at least seven LEDs electrically connected in series and a regulator circuit. The LEDs of an LED cluster can be arranged such that one LED is located at a central point of the LED cluster and the remaining LEDs are arranged in a circular geometry around the center LED. The master power controller can be coupled to the circuit board and can be configured to control the power provided to the LED clusters.

Another aspect of the present invention can include an improved light-emitting diode (LED) light fixture that includes a circuit board, multiple LED clusters, and a master power controller. The LED clusters can be arranged on the circuit board and can include at least three LEDs electrically connected in series and a regulator circuit. The LEDs can be arranged in a circular geometry within the LED cluster. The master power controller can be coupled to the circuit board and can be configured to control the power provided to the LED clusters.

Yet another aspect of the present invention can include a light-emitting diode (LED) configuration for lighting purposes. Such an LED configuration can include at least three LEDs electrically connected in series as an LED cluster upon a surface of a circuit board. The at least three LEDs can be evenly-spaced along a perimeter of a circular geometry. When there are at least seven LEDs in the LED cluster, at least one LED can be located in a central position of the LED cluster.

DETAILED DESCRIPTION

The present invention discloses an improved light-emitting diode (LED) light fixture. The improved LED light fixture can have multiple LED clusters arranged upon a circuit board. Each LED cluster can have at least three LEDs connected in series. The LEDs and LED clusters can be arranged in a circle and may have a LED or LED cluster centrally positioned. This type of arrangement of LEDs and LED clusters can produce a greater measured lumen output than conventional LED light fixtures.

As will be appreciated by one skilled in the art, aspects of the present invention may be embodied as a system, method or. Accordingly, aspects of the present invention may take the form of an entirely hardware embodiment or an embodiment combining software (including firmware, resident software, micro-code, etc.) and hardware aspects that may all generally be referred to herein as a "circuit," "module" or "system". Aspects of the present invention are described below with reference to flowchart illustrations and/or block diagrams of methods and/or apparatus (systems) according to embodiments of the invention.

Figure 1:
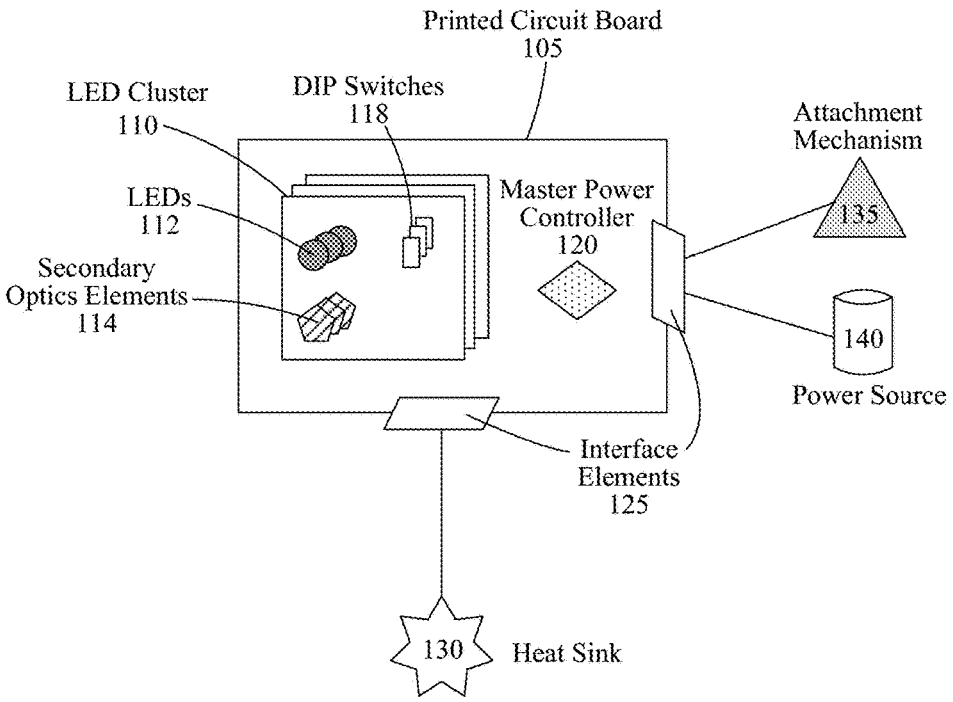
FIG. 1 is a block diagram illustrating an improved light-emitting diode (LED) light in accordance with embodiments of the inventive arrangements disclosed herein.

FIG. 1 is a block diagram illustrating an improved light-emitting diode (LED) light 100 in accordance with embodiments of the inventive arrangements disclosed herein. The LED light 100 can be designed for high-power applications, indoor and/or outdoor, where luminance is desired at distances of 100 ft. or more. Example applications of the LED light 100 can include, but are not limited to, streetlights, industrial (e.g., warehouse, factories, etc.) lighting systems, office lighting systems, sports stadiums, parking lots/garages, and the like.

The LED light 100 can have a primary component comprised of a printed circuit board 105. The printed circuit board 105 can be manufactured in accordance with standard methods that acceptable for use with LED technology. Components coupled to a surface of the printed circuit board 105 can include multiple LED clusters 110, a master power controller 120, and interface elements 125.

In another contemplated embodiment, the LED light 100 can have an alternate primary component to which multiple printed circuit boards 105 can be attached; each printed circuit board 105 can support an LED cluster 110, while the master power controller 120 and interface elements 125 can be elements of the alternate primary component.

For example, the alternate primary component can be a plastic disc having receptacles in which the printed circuit board 105 of each LED cluster 110 can be placed. The disc can have openings for wiring and/or connection points (i.e., interface elements 125) for each LED cluster 110 to be connected to the master power controller 120 and/or other necessary elements.

The LED clusters 110 can be arranged upon the printed circuit board 105 in a predetermined configuration. Each LED cluster 110 can include multiple LEDs 112, optional secondary optics elements 114, and DIP switches 118. The term "cluster", as used herein, can refer to a grouping of LEDs 112 that are located closer to other LEDs 112 in the same cluster than to LEDs 112 of a different cluster.

An LED cluster 110 can have at least three LEDs 112 that are electrically connected upon the printed circuit board 105 in a series. Other contemplated embodiments can include LED clusters 110 having five, six, or seven LEDs 112. Further, LED clusters 110 having different quantities of LEDs 112 can be incorporated on the same printed circuit board 105. That is, the LED clusters 110 of the printed circuit board 105 need not be homogenous.

The LEDs 112 of the LED cluster 110 can be produced in accordance with standard semiconductor manufacturing practices and can have characteristics (e.g., color, luminance, power consumption, size, etc.) applicable for the specific type of LED light 100. For example, LUXEON REBEL (LXML-PWC1-100) LEDs 112 can be used.

The secondary optics elements 114 can represent optional accessories that can be mounted over the LEDs 112 of the LED cluster 110 to change the light distribution of the LEDs 112. The secondary optics elements 114 can provide directed lighting capabilities like spot lighting, flood lighting, side emitting, and factory optics without having to change the power supplied to the LEDs 112.

The master power controller 120 can be an electronic component that controls the power distributed to the LED clusters 110 from the power source 140. The DIP switches 118 can be used to provide optional configurability for different types of lighting modes. For example, when the LED light 100 is used in a lighting system that supports dimming or energy savings modes, the positioning of the one or more DIP switches 118 associated with the LED cluster 110 can indicate the operating mode of the LED cluster 110.

The interface elements 125 can represent a variety of items required to couple the printed circuit board 105 to other components like a heat sink 130, attachment mechanism 135, and power source 140. For example, the attachment mechanism 135 can be coupled to the printed circuit board 105 via a housing using screws 125.

A heat sink 130 can be used to dissipate excess heat generated by the LED clusters 110 as well as counteract heat from the external environment. This can be of particular importance due to the temperature-sensitivity of the LEDs 112 with respect to performance as well as the high-power nature of the application (i.e., more power tends to equal more heat).

The attachment mechanism 135 can represent the mechanical components require to affix the LED light 100 to a desired physical location within an appropriate fixture or mounting surface. The attachment mechanism 135 can include elements that retrofit the LED light 100 into existing, non-LED lighting systems.

The power source 140 can provide the LED light 100 with power. The power source 140 can be a stand-alone element like a solar panel or battery, or can be a connection to a commercial power network. The power source 140 can be capable of providing the LED light 100 with power in a specified operating range.

Figure 2:
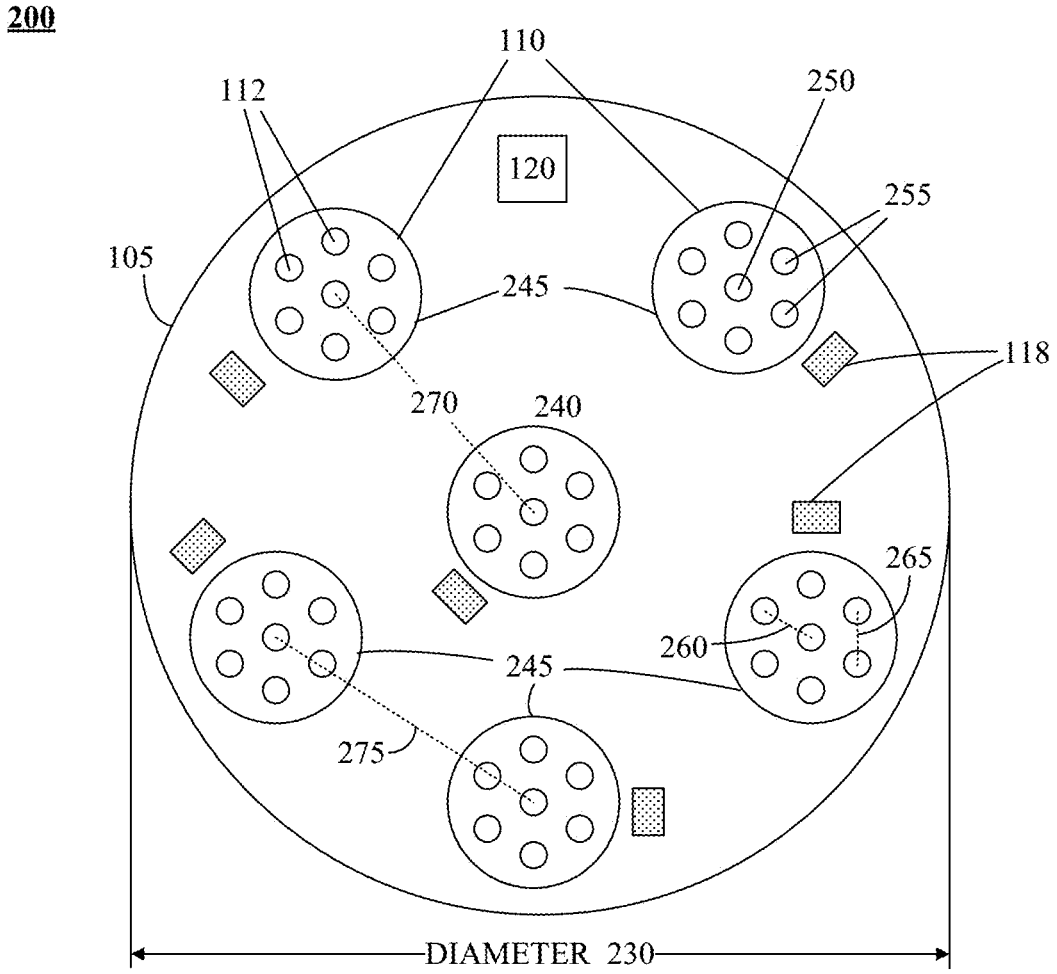
FIG. 2 is a schematic diagram of an example configuration for the improved LED light in accordance with an embodiment of the inventive arrangements disclosed herein.

FIG. 2 is a schematic diagram of an example configuration for the improved LED light 200 in accordance with embodiments of the inventive arrangements disclosed herein. This example configuration can represent a specific embodiment of the LED light 100 from FIG. 1.

As shown in this example configuration, the printed circuit board 105 of the improved LED light 200 can be of a circular geometry; other geometries (e.g., square, rectangular, triangular, etc.) can be also used in other embodiments. The printed circuit board 105 can have a diameter 230 of 5.6 inches or be of a size that allows the LED light 200 to fit into the intended fixture.

As previous discussed, the printed circuit board 105 can include a master power controller 120 that governs multiple LED clusters 110, each LED cluster 110 having multiple LEDs 112 and a corresponding DIP switch 118. In this example, the improved LED light 200 can include six LED clusters 110 arranged with one central LED cluster 240 and five evenly-spaced peripheral LED clusters 245. Each peripheral LED cluster 245 can be positioned at a distance 270 of 2.0 inches from the central LED cluster 240 and a distance 275 of 2.2 inches from adjacent peripheral LED clusters 245, when measured from the center of each central LED 250.

Each LED cluster 110 can be a substantially circular-shaped component, though other shapes are contemplated. The LEDs 112 of each LED cluster 110 can be arranged with one central LED 250 and the remaining as peripheral LEDs 255. The peripheral LEDs 255 can be equidistant from and evenly-spaced around the central LED 250. In this example configuration, each peripheral LED 255 can have a center-to-center separation 260, 265 of 0.5 inches from the central LED 250 and adjacent peripheral LEDs 255. The center-to-center separation 260, 265 of the LEDs 112 in an LED cluster 110 can be critical to ensure proper light displacement.

This clustering arrangement is key to the improved functionality of the LED light 200. Conventional LED lights designed for this type of application arrange the LEDs 112 in linear strips or panels and require more LEDs 112 to provide a comparable lumen output. For example, a "Big Bulb" LED streetlight replacement procurable from a generic commercial source (see http://www.led-cfl-light-house.com/page/1433707) can provide 2240 lumens using 28 LEDs 112 in a panel array configuration.

Figure 2A:
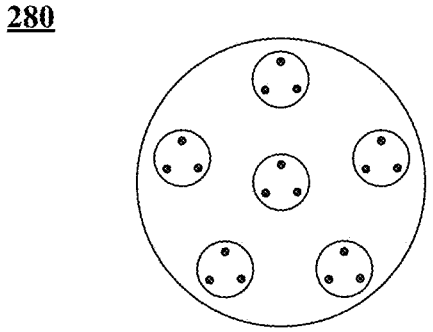
FIG. 2A The configuration shown in FIG. 2A can be comparable to the "Big Bulb", but utilizing the LED clustering arrangement to provide 2220-4554 lumens, depending upon desired wattage, using only eighteen LEDS.

The configuration shown in FIG. 2A can be comparable to the "Big Bulb", but utilizing the LED clustering arrangement to provide 2220-4554 lumens, depending upon desired wattage, using only eighteen LEDS 112, six LED clusters 110 of three LEDs 112 each; LED light 200 can provide 5586-8080 lumens with its 42 LEDs 112. Thus, the clustering arrangement can out perform existing LED arrangements in terms of light output for the same amount of LEDs, providing more light in the desired area than comparable, conventional LED lights. Thus, utilizing the optical arrangements described herein, the end results form a LED emitter produces a greater lumen output by at least ten percent compared to utilizing the same LED bulbs at an equivalent power but in linear panel arrangement. In other embodiments, a twenty or thirty percent greater lumen output has been achieved, as noted above by experimental results elaborated upon in U.S. provisional 61/582,101, which is referenced and incorporated by reference herein.

Therefore, it is important to emphasize that the clustering of the LEDs 112 can be the factor that improves the functionality of the LED light 200. That is, if the 42 LEDs 112 of the improved LED light 200 were arranged in a panel configuration (i.e., six rows of seven LEDs 112) the lumen output would be considerably less than the LED cluster 110 configuration shown in FIG. 2.

Figure 3:
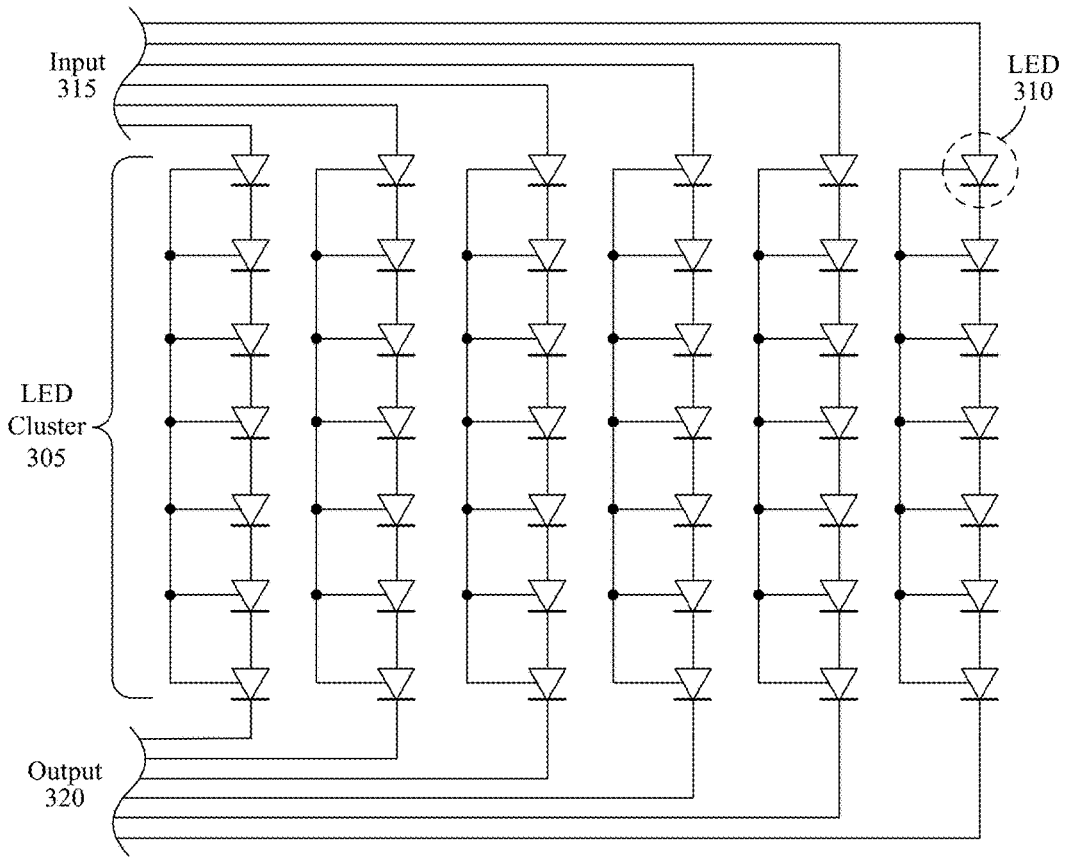
FIG. 3 is a circuit diagram for an example configuration of the improved LED light in accordance with an embodiment of the inventive arrangements disclosed herein.

FIG. 3 is a circuit diagram 300 for an example configuration of the improved LED light in accordance with embodiments of the inventive arrangements disclosed herein. Circuit diagram 300 can represent the improved LED light 200 of FIG. 2.

In circuit diagram 300, each of the six LED clusters 305 can have seven LEDs 310 connected in series. That is, the electrical current can pass through each of the seven LEDs 310 in succession without branching. The LED clusters 305 can be connected in parallel, as each LED cluster 305 has a separate input 315 and output 320 wire.

Figure 4:
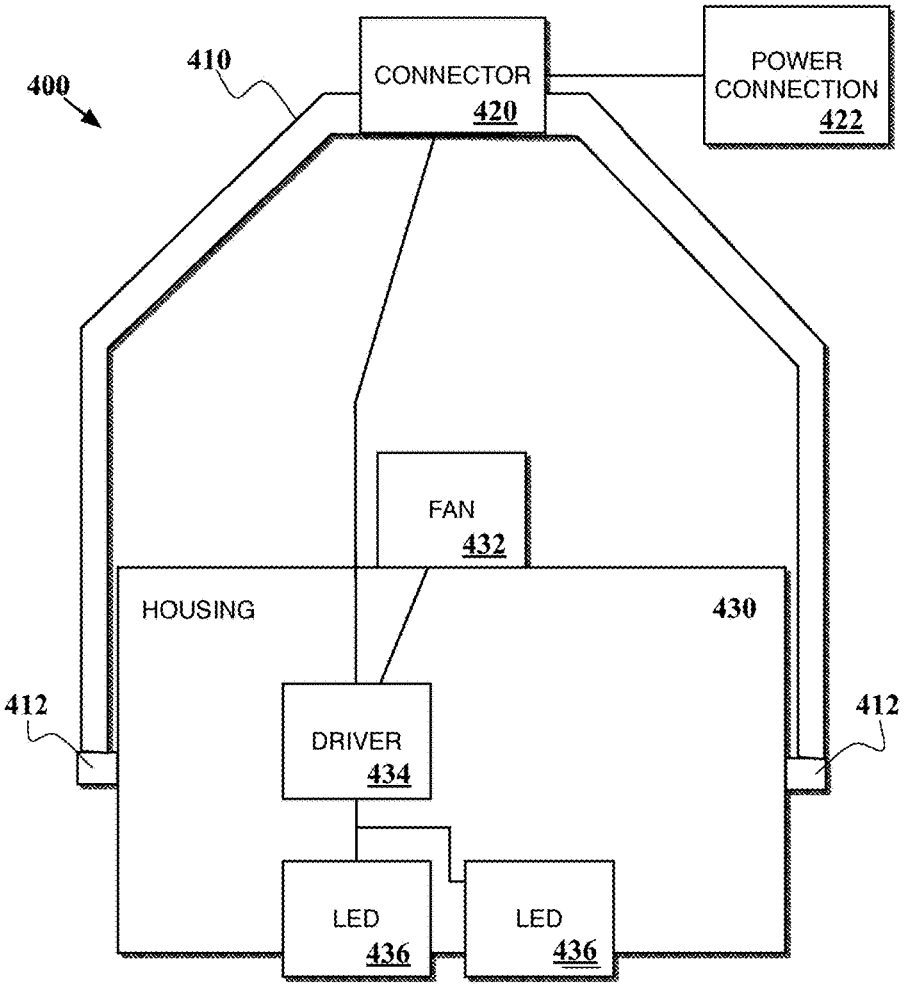
FIG. 4 depicts a high-level functional block diagram of bulb utilizing one or more LED clusters in accordance with an embodiment of the inventive arrangements disclosed herein.

The LED Clusters detailed herein can interoperate in accordance with numerous configurations, one of which is shown in FIG. 4. FIG. 4 depicts a high-level functional block diagram of bulb 400 utilizing one or more LED clusters, the bulb 400 comprising housing 430 and bracket 410. Housing 430 comprises LED units 436, e.g., LED circuit, etc., a driver circuit 434 for controlling power provided to LED units 436, and fan 432. LED units 436 and fan 432 are operatively and electrically coupled to driver 434 which is, in turn, electrically coupled to connector 420 and power connection 422.

LED units 436 generate light responsive to receipt of current from driver 434. In one embodiment, each LED unit 436 can represent a LED cluster. In another embodiment, each LED unit 436 represents a single element or LED of a LED cluster.

In at least some contemplated embodiments, driver circuit 434 is not a part of housing 430 and is instead connected between power connection 422 and connector 420.

In at least some embodiments, LED units 436 and fan 432 are electrically coupled to a single connection to driver 434. For example, in at least some embodiments, the electrical connection between driver 434 and LED units 436 and fan 432 comprises a single plug connection. The single plug connection may be plugged and unplugged by a user without requiring the use of tools.

In at least some embodiments, housing 430 may comprise a greater number of LED units 436. In at least some embodiments, housing 430 may comprise a greater number of fans 432.

Fan 432 rotates responsive to receipt of current from driver 434. Rotation of fan 432 causes air to be drawn in through vents in front face and expelled via vents in rear face. The flow of air through bulb 400 by rotation of fan 432 removes heat from the vicinity of LED units 436 thereby reducing the temperature of the LED unit. Maintaining LED unit 436 below a predetermined temperature threshold maintains the functionality of LED unit 436. In at least some embodiments, LED unit 436 is negatively affected by operation at a temperature exceeding the predetermined temperature threshold. In at least some embodiments, the number of vents is dependent on the amount of air flow needed through the interior of LED bulb 400 to maintain the temperature below the predetermined threshold. In at least some embodiments, fan 432 may be replaced by one or more cooling devices arranged to keep the temperature below the predetermined temperature threshold. For example, in some embodiments, fan 432 may be replaced by a movable membrane or a diaphragm or other similar powered cooling device.

In at least some embodiments, fan 432 is integrally formed as a part housing 430. In at least some other embodiments, fan 432 is directly connected to housing 430. In still further embodiments, fan 432 is physically connected and positioned exclusively within housing 430.

In at least some embodiments, fan 432 may be operated at one or more rotational speeds. In at least some embodiments, fan 432 may be operated in a manner in order to draw air into bulb 400 via the vents on rear face and expel air through vents on front face. By using fan 432 in LED bulb 400, thermal insulating material and/or thermal transfer material need not be used to remove heat from the LED bulb interior.

In at least some embodiments, fan 432 operates to draw air away from housing 430 and toward a heat sink adjacent LED bulb 400. For example, given LED bulb 400 installed in a light fixture, fan 432 pulls air away from housing 430 and LED units 436 and pushes air toward the light fixture, specifically, air is moved from LED bulb 400 toward the light fixture.

In at least some embodiments, existing light fixtures for using high output bulbs, e.g., high-intensity discharge (HID), metal halide, and other bulbs, are designed such that the light fixture operates as a heatsink to remove the heat generated by the HID bulb from the portion of the fixture surrounding the bulb and the bulb itself. In a retrofit scenario in which LED bulb 400 replaces an existing light bulb, e.g. a HID bulb, in a light fixture designed for the existing light bulb, fan 432 of LED bulb 400 operates to move air from the LED bulb toward the existing heat sink of the light fixture. Because LED bulb 400 typically generates less heat than the existing bulb, the operation of fan 432 in connection with the LED bulb increases the life of the LED bulb within the light fixture. LED bulb 400 including fan 432 takes advantage of the design of the existing light fixture heatsink functionality.

Driver 434 comprises one or more electronic components to convert alternating current (AC) received from connector 110 connected to a power connection 422, e.g., a mains power supply or receiving socket, to direct current (DC). Driver 434 transmits the converted current to LED units 436 and fan 432 in order to control operation of the LED unit and fan. In at least some embodiments, driver 434 is configured to provide additional functionality to bulb 400. For example, in at least some embodiments, driver 434 enables dimming of the light produced by bulb 400, e.g., in response to receipt of a different current and/or voltage from power connector 422.

In at least some embodiments, driver 434 is integrated as a part of housing 430. In at least some embodiments, driver 434 is configured to receiver a range of input voltage levels for driving components of housing 430, i.e., LED units 436 and fan 432. In at least some embodiments, driver 434 is configured to receive a single input voltage level.

Bracket 410 also comprises connection point 412 for removably and rotatably attaching the bracket and housing. In at least some embodiments, connection point 412 is a screw. In at least some further embodiments, connection point 412 is a bolt, a reverse threading portion for receipt into housing 430, a portion of a twist-lock or bayonet mechanism.

In operation, if one or more LED units 436 in a particular housing 430 degrades or fails to perform, the entire LED bulb 400 need not be replaced. In such a situation, only housing 430 needs replacing. Similarly, if driver 434 fails or degrades in performance, only housing 430 needs to be replaced. If, in accordance with alternate embodiments, driver circuit 434 is connected external of bulb 400, driver circuit 424 may be replaced separate from bulb 400. Because of the use of releasably coupled components, i.e., bracket 410 and housing 430, the replacement of one or the other of the components may be performed on location with minimal or no tools required by a user. That is, the user may remove LED bulb 400 from a socket, replace housing 430 with a new housing, and replace the LED bulb into the socket in one operation. Removal of LED bulb 400 to another location or transport of the LED bulb to a geographically remote destination for service is not needed. Alternatively, the user may remove driver circuit 434 from between power connection 422 and connector 420, in applicable embodiments, and replace the driver. Also, if the user desires to replace a particular driver 434 of a bulb 400, the user need only remove and replace the currently connected driver 434. For example, a user may desire to replace a non-dimmable driver with a driver which supports dimming. Also, a user may desire to replace a driver having a shorter lifespan with a driver having a longer lifespan. Alternatively, a user may desire to replace a housing having a particular array of LED units 436 with a different selection of LED units 436, e.g., different colors, intensity, luminance, lifespan, etc.; the user need only detach housing 430 from bracket 410 and reattach the new housing 430 to the bracket.

Figure 5:
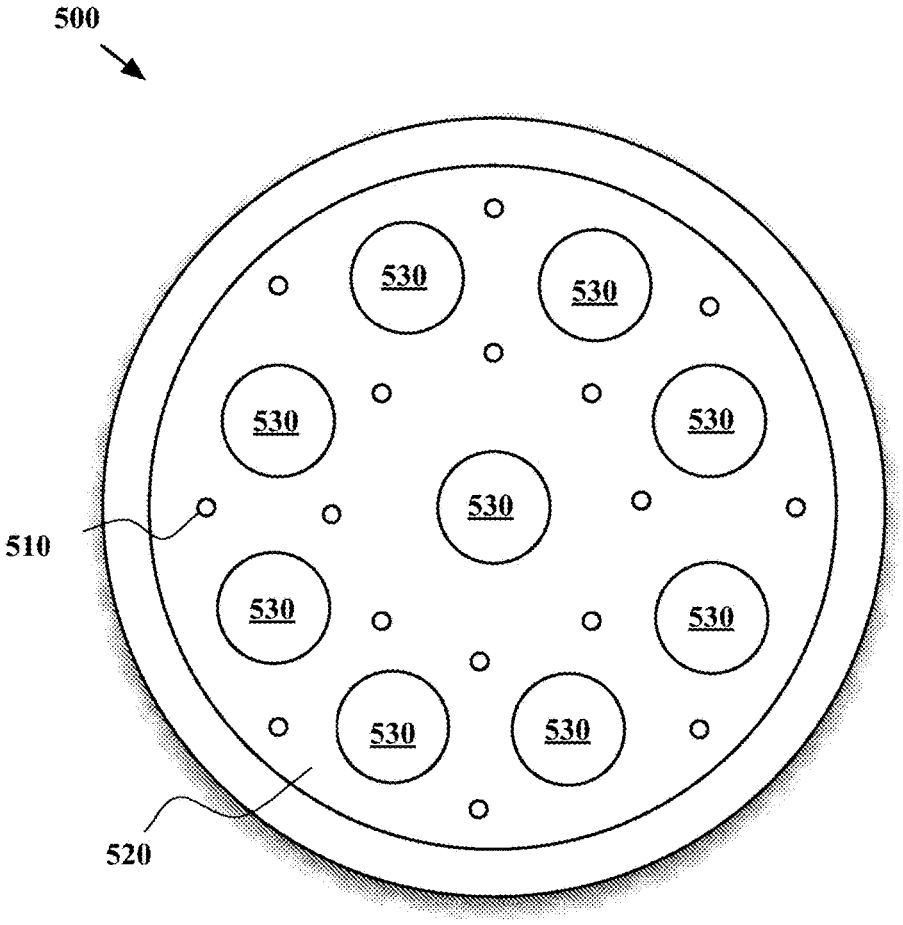
FIG. 5 depicts a front plan view of front face of a LED bulb in accordance with an embodiment of the inventive arrangements disclosed herein.

FIG. 5 depicts a front plan view of front face 520 of LED bulb 500 according to another embodiment wherein the bulb comprises more than one LED unit 530. LED bulb 500 may comprises a plurality of front vents 510. Because of the greater number of LED units 530, there may be a need for a greater number of front vents 510 (compared to implementations with fewer LED units 530) or the front vents may be larger in size (compared to implementations with fewer LED units 530). In at least some embodiments, LED units 530 may comprise different size, shape, and light-emitting characteristics.

Figure 6:
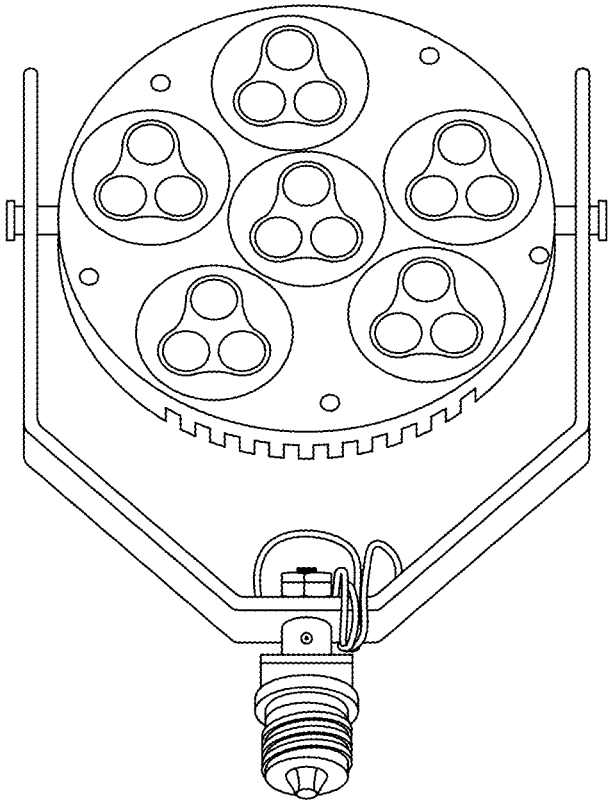
FIG. 6 is an illustration of a bulb in accordance with an embodiment of the inventive arrangements disclosed herein.

FIG. 6 is an illustration of an embodiment of bulb of one contemplated embodiment in a flat state. The bulb as illustrated comprises connection point affixed to housing. The illustrated connection point passes through openings in an arm of a bracket to enable the housing to be positioned along the length of the arm, in addition to enabling the rotation of the housing. FIG. 6 also depicts a bulb with a power connection attached to a connector.

Figure 7:
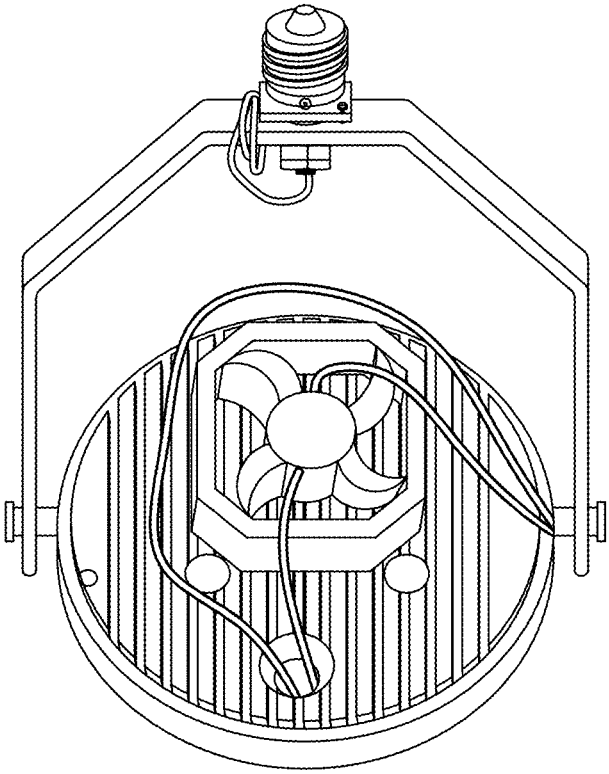
FIG. 7 is an illustration of a bulb having a housing in accordance with an embodiment of the inventive arrangements disclosed herein.

FIG. 7 is an illustration of one contemplated embodiment of a bulb having a housing at an angular displacement around the connection points, such that the housing is positioned at approximately a ninety degree angle with respect to the support arm.

Figure 8:
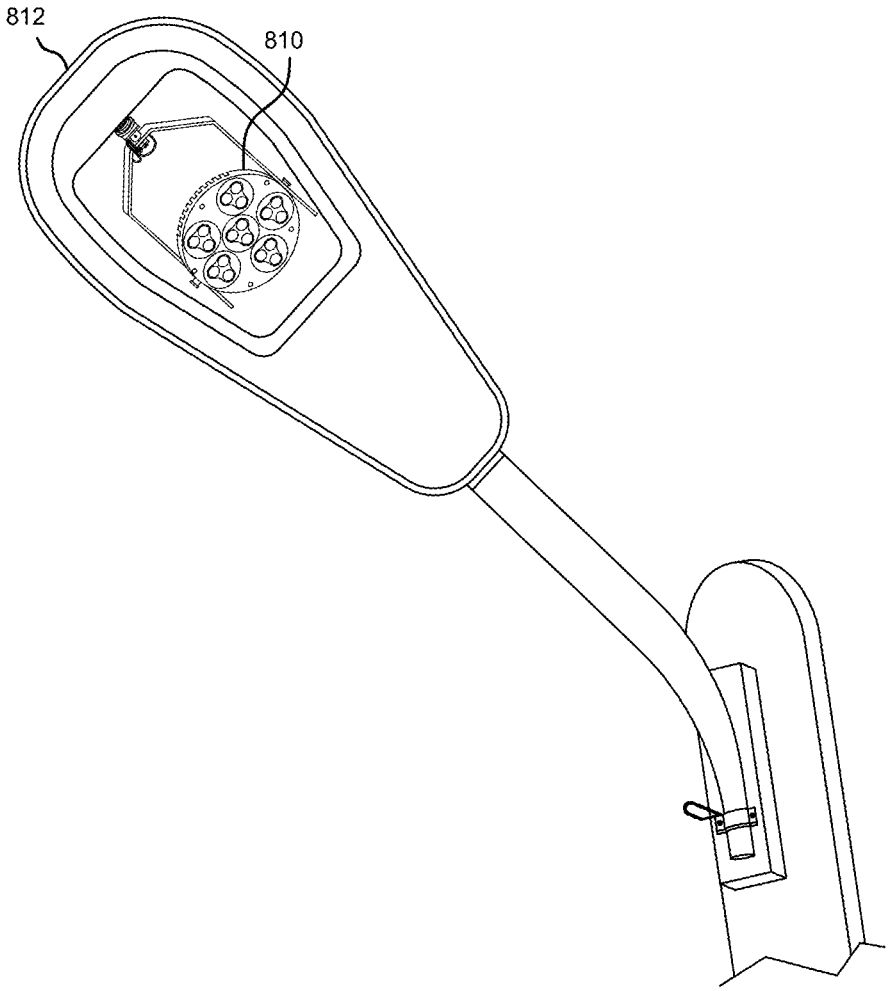
FIG. 8 depicts an image of an LED bulb installed in a light fixture in accordance with an embodiment of the inventive arrangements disclosed herein.

FIG. 8 depicts an image of an LED bulb 810 installed in a light fixture 812 in accordance with a contemplated embodiment of the disclosure.

It should be understood that embodiments detailed herein are for illustrative purposes only and that other configurations are contemplated. For specifically, any arrangement of LED clusters consistent with the disclosure provided herein is to be considered within the scope of the disclosure.

The flowchart and block diagrams in the Figures illustrate the architecture, functionality, and operation of possible implementations of systems and/or methods according to various embodiments of the present invention. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

What is claimed is:

1. A light-emitting diode (LED) light fixture comprising:

a circuit board;

a LED emitter comprising a plurality of at least three LED clusters electrically connected on the circuit board, wherein the plurality of at least three LED clusters arranged on said circuit board, wherein the at least three LED cluster are equal distance from an emitter central point of the LED emitter, and wherein a center of each of the at least three LED clusters are a fixed and equal distance from each adjacent one of the at least three LED clusters, wherein each of the at least three LED cluster further comprises:

at least three LED bulbs electrically connected in series within one of the plurality of at least three LED clusters within which the at least three LED bulbs reside, wherein the at least three LED cluster are equal distance from a cluster central point of the one of the plurality of at least three LED clusters within which the at least three LED bulbs reside, and wherein a center point of each of the at least three LED bulbs are a fixed and equal distance from each adjacent one of the at least three LED bulbs;

a master power controller coupled to the circuit board configured to control power provided to the plurality of LED clusters, wherein each of the plurality of at least three LED clusters is the same size as each other one of the plurality of at least three LED clusters, wherein each of the LED clusters includes the same number of LED bulbs, and wherein power requires of each of the plurality of at least three LED clusters is equivalent to each of the other one of the plurality of at least three LED clusters; and secondary optics having a light focusing effect on each of the plurality of at least three LED clusters, such that for each of the plurality of at least three LED clusters, a cluster specific focus is achieved when light emitted by included LED bulbs passes through the secondary optics element and is outwardly focused and projected by the secondary optics element, wherein the secondary optics comprise at least three focusing elements, each being a circular shape centered on the cluster central point of one of the at least three LED clusters to which one of the at least three focusing elements corresponds, wherein optical characteristics of an aggregate of the plurality of at least three LED clusters, of the at least three LED bulbs, and the secondary optics, produces a greater lumen output by at least ten percent compared to utilizing the same LED bulbs at an equivalent power but in linear strip or a linear panel arrangement.

2. The LED light fixture of claim 1, further comprising:

a central LED cluster, which is in addition to the plurality of at least three LED clusters, wherein a center of the central LED cluster is positioned at the emitter central point, wherein the central LED cluster further comprises:

at least three LED bulbs electrically connected in series within the central LED cluster, wherein a center point of each of the at least three LED bulbs of the central LED cluster are a fixed and equal distance from an adjacent neighbor and are an equal distance from the emitter central point.

3. The LED light fixture of claim 1, wherein each of the at least three LED clusters further comprises:

a central LED bulb, which is in addition to the plurality of at least three LED bulbs, wherein a center of the central LED bulb is positioned at the cluster central point of a corresponding one of the at least three LED clusters.

4. The LED light fixture of claim 1, wherein the LED light fixture is designed for a high power arrangement where luminescence from the LED emitter is projected at distances of 100 feet or greater.

5. The LED light fixture of claim 1, wherein each of the plurality of at least three LED clusters further comprises:

at least one dual in-line package (DIP) switch whose distinct positioning combinations define operating modes of a corresponding one of the at least three LED clusters.

6. The LED light fixture of claim 1, wherein said LED emitter provides output of at least five thousand lumens.

7. The LED light fixture of claim 1, further comprising:

a heat sink capable of being coupled to the circuit board configured to dissipate heat away from the plurality of at least three LED clusters.

8. The LED light fixture of claim 1, further comprising:

an attachment mechanism capable of being coupled to the circuit board and configured to couple said LED light fixture to a lighting system.

9. The LED light fixture of claim 1, wherein the LED light fixture has at least five LED clusters and wherein each of the LED clusters has at least five LED bulbs.

10. A light-emitting diode (LED) light fixture comprising:

a circuit board;

a LED emitter comprising a plurality of at least three LED clusters electrically connected on the circuit board, wherein the plurality of at least three LED clusters arranged on said circuit board, wherein the at least three LED cluster are equal distance from an emitter central point of the LED emitter, and wherein a center of each of the at least three LED clusters are a fixed and equal distance from each adjacent one of the at least three LED clusters, wherein each of the at least three LED cluster further comprises:

at least three LED bulbs electrically connected in series within one of the plurality of at least three LED clusters within which the at least three LED bulbs reside, wherein the at least three LED cluster are equal distance from a cluster central point of the one of the plurality of at least three LED clusters within which the at least three LED bulbs reside, and wherein a center point of each of the at least three LED bulbs are a fixed and equal distance from each adjacent one of the at least three LED bulbs;

a master power controller coupled to the circuit board configured to control power provided to the plurality of LED clusters, wherein each of the plurality of at least three LED clusters is the same size as each other one of the plurality of at least three LED clusters, wherein each of the LED clusters includes the same number of LED bulbs, and wherein power requires of each of the plurality of at least three LED clusters is equivalent to each of the other one of the plurality of at least three LED clusters, wherein optical characteristics of an aggregate of the plurality of at least three LED clusters and of the at least three LED bulbs produce light at distances of 100 feet or greater and produces a greater lumen output by at least twenty percent compared to utilizing the same LED bulbs at an equivalent power but in linear strip or linear panel arrangement.

11. The LED light fixture of claim 10, further comprising:

a central LED cluster, which is in addition to the plurality of at least three LED clusters, wherein a center of the central LED cluster is positioned at the emitter central point, wherein the central LED cluster further comprises:

at least three LED bulbs electrically connected in series within the central LED cluster, wherein a center point of each of the at least three LED bulbs of the central LED cluster are a fixed and equal distance from an adjacent neighbor and are an equal distance from the emitter central point.

12. The LED light fixture of claim 10, wherein each of the at least three LED clusters further comprises:

a central LED bulb, which is in addition to the plurality of at least three LED bulbs, wherein a center of the central LED bulb is positioned at the cluster central point of a corresponding one of the at least three LED clusters.

13. The LED light fixture of claim 10, wherein the LED light fixture produces at least five thousand lumens of output.

14. The LED light fixture of claim 10, wherein the LED light fixture has at least five LED clusters.

15. The LED light fixture of claim 10, further comprising:

a plurality of secondary optics elements, one corresponding to each of the LED clusters, each of the secondary optics elements being a circular shape centered on a central point of the corresponding LED cluster and each of the secondary optics elements covering each of the LED bulbs of the corresponding cluster such that light emitted from each of the LED bulbs passes through the secondary optics element that covers the corresponding LED cluster, wherein each of the secondary optics elements changes a light distribution pattern of the corresponding LED cluster.

16. The LED light fixture of claim 10, further comprising:

a plurality of dual in-line package (DIP) switches whose distinct positioning combinations define operating modes of a corresponding one of the LED clusters.

17. The LED light fixture of claim 10, wherein the LED light fixture is a bulb for a highway street lamp.

18. A light-emitting diode (LED) configuration for lighting purposes comprising:

a circuit board;

a LED emitter comprising a plurality of at least three LED clusters electrically connected on the circuit board, wherein the plurality of at least three LED clusters arranged on said circuit board, wherein the at least three LED cluster are equal distance from an emitter central point of the LED emitter, and wherein a center of each of the at least three LED clusters are a fixed and equal distance from each adjacent one of the at least three LED clusters, wherein each of the at least three LED cluster further comprises:

at least three LED bulbs electrically connected in series within one of the plurality of at least three LED clusters within which the at least three LED bulbs reside, wherein the at least three LED cluster are equal distance from a cluster central point of the one of the plurality of at least three LED clusters within which the at least three LED bulbs reside, and wherein a center point of each of the at least three LED bulbs are a fixed and equal distance from each adjacent one of the at least three LED bulbs; and;

secondary optics having a light focusing effect on each of the plurality of at least three LED clusters, such that for each of the plurality of at least three LED clusters, a cluster specific focus is achieved when light emitted by included LED bulbs passes through the secondary optics element and is outwardly focused and projected by the secondary optics element, wherein optical characteristics of an aggregate of the plurality of at least three LED clusters and of the at least three LED bulbs and the secondary optics provides output of at least five thousand lumens, projects light at a distance of at least 100 feet, and produces a greater lumen output by at least ten percent compared to utilizing the same LED bulbs at an equivalent power but in linear panel arrangement.

19. The LED configuration of claim 18, wherein each of the at least three LED clusters further comprises:

a central LED bulb, which is in addition to the plurality of at least three LED bulbs, wherein a center of the central LED bulb is positioned at the cluster central point of a corresponding one of the at least three LED clusters, wherein the LED configuration further comprising:

a central LED cluster, which is in addition to the plurality of at least three LED clusters, wherein a center of the central LED cluster is positioned at the emitter central point, wherein the central LED cluster further comprises:

at least three LED bulbs electrically connected in series within the central LED cluster, wherein a center point of each of the at least three LED bulbs of the central LED cluster are a fixed and equal distance from an adjacent neighbor and are an equal distance from the emitter central point.

* * * * *